US005586958A

United States Patent [19]

Little, Sr.

[11] Patent Number: 5,586,958

[45] Date of Patent: Dec. 24, 1996

[54] LOWER LEG EXERCISE DEVICE

[76] Inventor: Oscar L. Little, Sr., P.O. Box 2621, Danbury, Conn. 06813

[21] Appl. No.: 543,557

[22] Filed: Oct. 16, 1995

Related U.S. Application Data

[62] Division of Ser. No. 344,944, Nov. 25, 1994, Pat. No. 5,487,711.

[51] Int. Cl.[6] ..... A63B 23/04

[52] U.S. Cl. ..... 482/79; 482/93

[58] Field of Search ..... 482/79, 80, 93, 482/97, 148, 51, 70, 71

[56] References Cited

U.S. PATENT DOCUMENTS 3,684,305 8/1972 McDonald et al. ..... 482/71
3,929,329 12/1975 Rivera ..... 482/79
4,337,939 7/1982 Hoyle et al. ..... 482/79

*Primary Examiner*—Stephen R. Crow
*Attorney, Agent, or Firm*—John H. Crozier

[57] ABSTRACT

In a preferred embodiment, a lower leg exercise device, including: a base member; two, elongate, parallel plates attached to rotating apparatus mounted on the base member; and support apparatus disposed at distal ends of the plates to accommodate thereon selected weights; such that a person standing on the plates, with a foot disposed over each of the rotating apparatus, moves the weights between a first, lowered position and a second, elevated position by alternatingly flexing and relaxing muscles in the person's lower leg.

4 Claims, 7 Drawing Sheets

LOWER LEG EXERCISE DEVICE

CROSS-REFERENCE TO RELATED APPLICATION

The present application is a division of application Ser. No. 08/344,944, filed Nov. 25, 1994, and titled LOWER LEG EXERCISE DEVICE AND METHOD, now U.S. Pat. No. 5,487,711, issued Jan. 30, 1996.

BACKGROUND OF THE INVENTION

1. Field of the Invention

The present invention relates to exercise devices generally and, more particularly, but not by way of limitation, to novel lower leg exercise device and method that are simple and economical.

2. Background Art

Physical exercise has become increasingly popular, as it improves a person's feelings of general well-being and is even thought to decrease the incidence of disease and to lengthen a person's life span. Exercising with weights has been demonstrated to have certain specific benefits such as increasing a person's blood level of desirable high density lipoproteins and decreasing osteoporosis-causing loss of calcium in the bones.

Many exercise weight training devices are relatively expensive and space-consuming, as well as being difficult to transport easily. This is particularly true of devices for exercising the lower legs.

Accordingly, it is a principal object of the present invention to provide exercise device and method that are simple and economical.

It is a further object of the invention to provide such exercise device and method that are particularly useful in exercising the lower legs.

It is an additional object of the invention to provide such exercise device that is compact and is easily transported and stored.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a lower leg exercise device, comprising: a base member; two, elongate, parallel plates attached to rotating means mounted on said base member; and support means disposed at distal ends of said plates to accommodate thereon selected weights; such that a person standing on said plates, with a foot disposed over each of said rotating means, moves said weights between a first, lowered position and a second, elevated position by alternatingly flexing and relaxing muscles in the person's lower leg.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
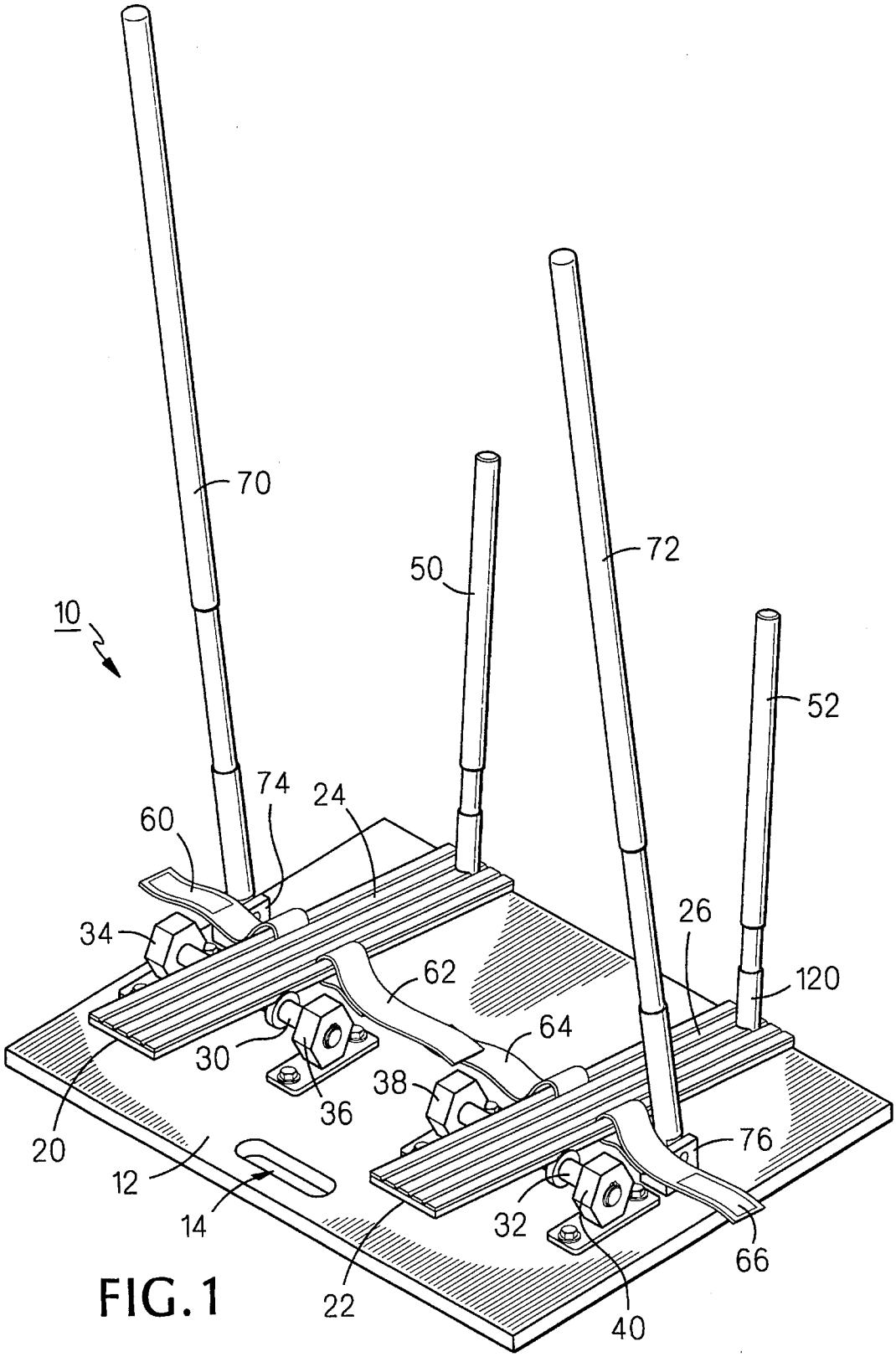
FIG. 1 is an isometric view of a lower leg exercise device according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a lower leg exercise device constructed according to the present invention, generally indicated by the reference numeral 10. Device 10 includes a planar base member 12 which may be placed on a horizontal surface such as a floor (not shown). Base member 12 may be formed from a suitable plastic material, about 18 inches long by about 24 inches wide, and with a handle cutout 14 defined medially along a long edge of the base member for the convenient carrying of exercise device 10.

Rotatably mounted on base member 12 are two elongate, steel plates 20 and 22 having, respectively, non-skid rubber layers 24 and 26 adhesively attached to the upper surfaces of the plates. Plates 20 and 22 are fixedly mounted, respectively, on horizontal shafts 30 and 32 journaled, respectively, in bearing block pairs 34/36 and 38/40, the bearing blocks being fixedly attached to base member 12.

Orthogonally mounted, respectively, on the distal ends of plates 20 and 22 are 1-inch diameter, 16-inches long, aluminum weight posts 50 and 52 and attached to edges of the plates are, respectively, complementary hook-and-loop fabric pairs 60/62 and 64/66. Telescoping support poles 70 and 72 are rotatably attached, respectively, to mounting blocks 74 and 76, the mounting blocks being fixedly attached to base member 12.

Figure 2:
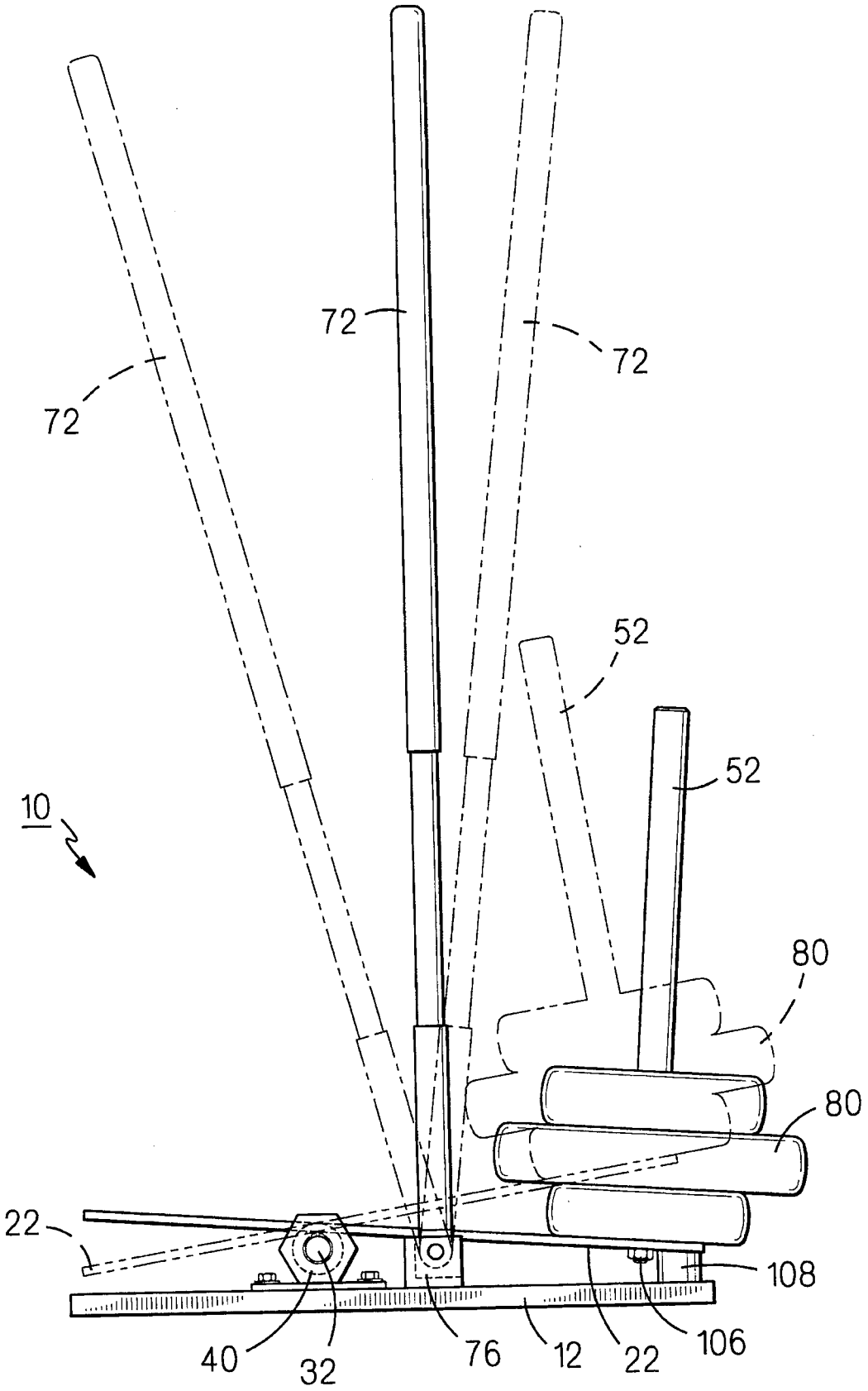
FIG. 2 is a side elevational view showing movements of elements of the exercise device.

FIG. 2 illustrates the movement of the moveable elements of exercise device 10 while in use. As is seen on FIG. 2, weight posts 50 and 52 (only the latter visible on FIG. 2) can accommodate thereon a number of selected conventional disk-shaped weights, as at 80. The distal ends of plates 20 and 22 (only the latter visible on FIG. 2) are rotatable between a first, lowered, position (solid lines), with weights 80 supported by base member 12, and a second, elevated position (broken lines), with the weights elevated from the base member. Similarly, the distal ends of support poles 70 and 72 (only the latter visible on FIG. 2) are selectively rotatable to forward and rearward positions (broken lines) from upright positions (solid lines). A rubber bumper 108 is secured to the upper surface of plate, the rubber bumper being provided to engage base member the distal end of plate 22 to cushion the plate when weights 80 are moved to the first, lowered position.

Figure 3:
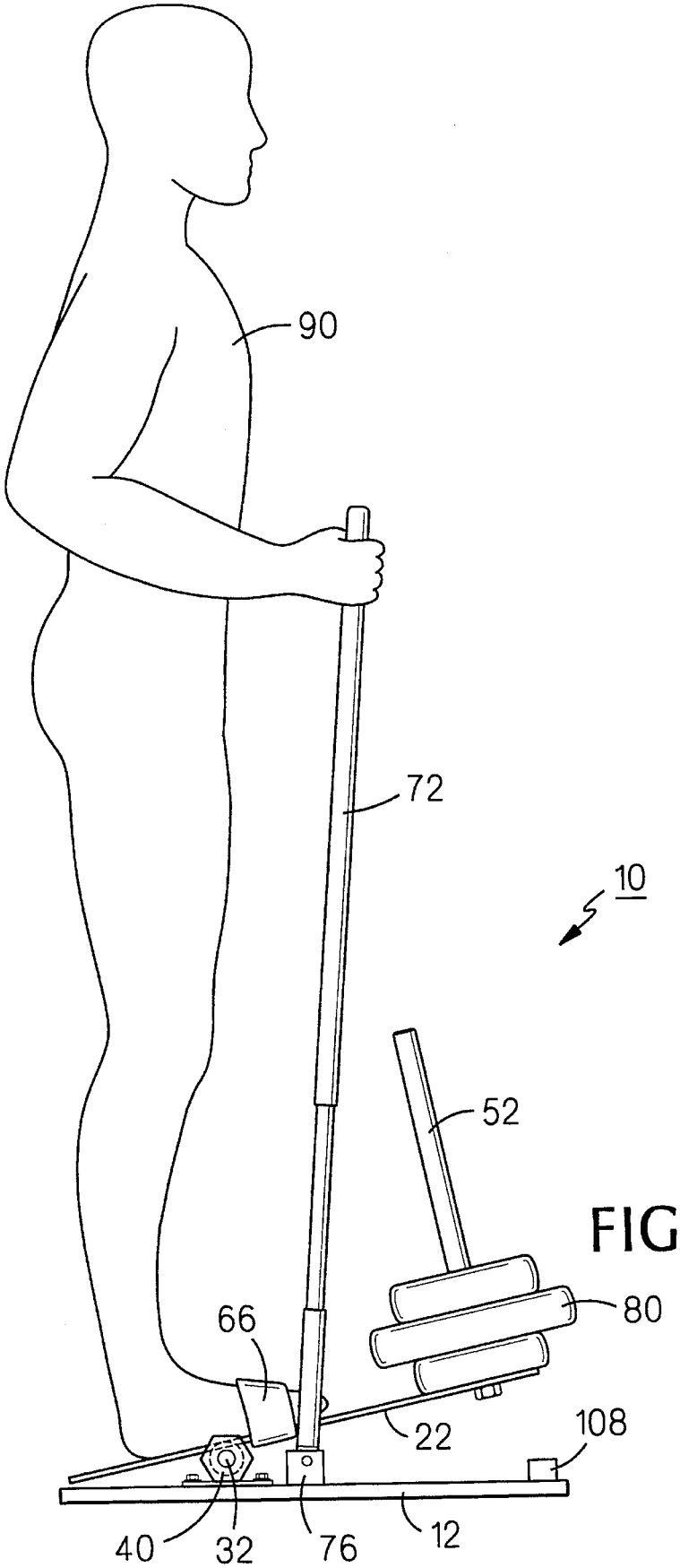
FIG. 3 a side elevational view showing a person using the exercise device in a first position.

FIG. 3 illustrates exercise device 10 being used by a person 90. It will be understood that only the elements visible on FIG. 2 are also visible on FIG. 3, although the other moving elements of exercise device 10 are simultaneously used in the same manner as the elements visible on FIG. 3. Person 90 stands on plate 12 with the person's right foot positioned over shaft 32, and with the person's right hand grasping the distal end of support pole 72, although use of the latter is optional. Then, person 90 alternatingly flexes and relaxes the person's muscles in the anterior portions of the person's lower legs to move, respectively, weights 80 between the first, lowered position (FIG. 2, solid lines) and the second, elevated position shown on FIG. 3. Velcro strap 66 may be used when the force to elevate weights 80 so requires to hold the front portion of the foot against plate 22. In addition to providing more or less weight, the amount of force required to elevate weights 80 to the second, elevated position may be selectively increased or decreased somewhat by person 90 moving, respectively, the person's feet closer to or farther away from the weights.

Figure 4:
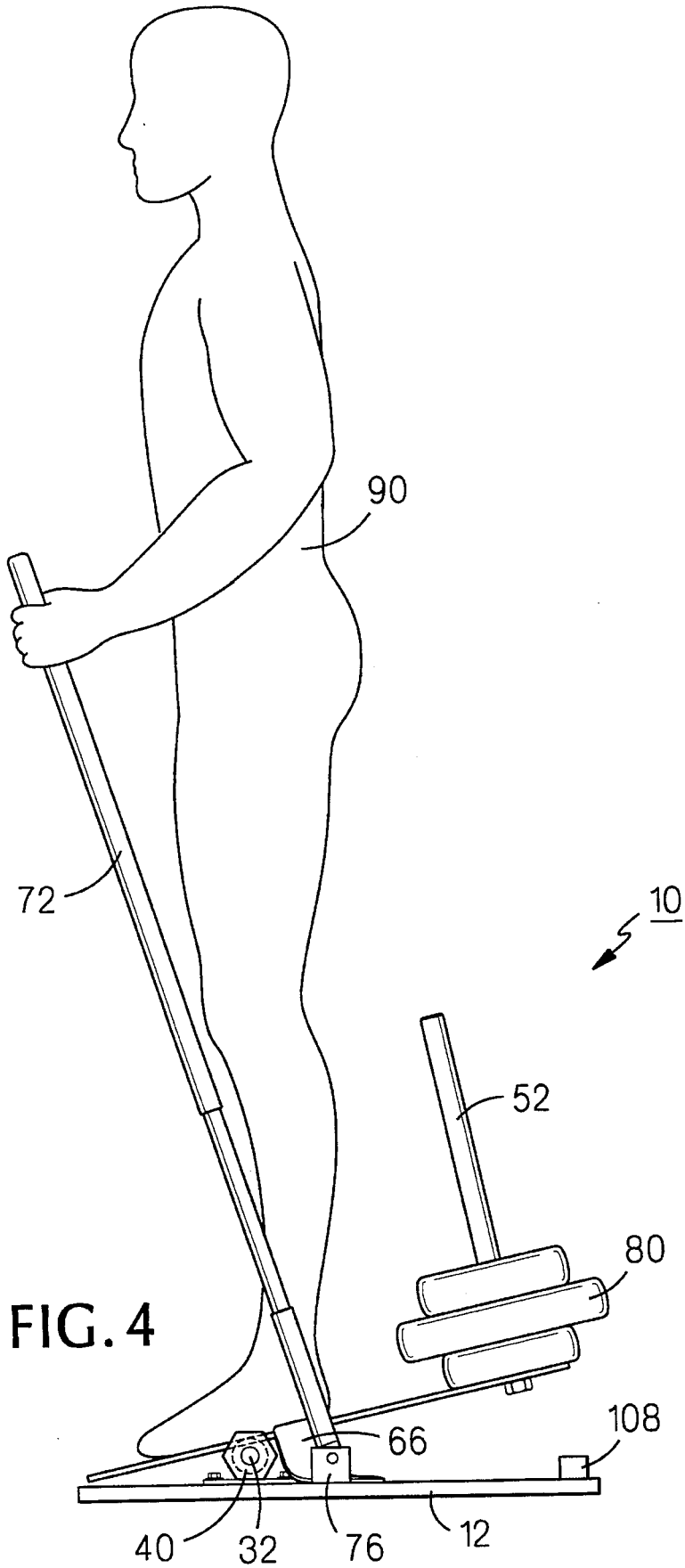
FIG. 4 is a side elevational view showing a person using the exercise device in a second position.

FIG. 4 illustrates person 90 using device 10 to exercise the posterior muscles of the lower leg. Here, rather than facing weights 80, person 90 is facing away from the weights. In a similar manner as described with reference to FIG. 3, alternatingly flexing and relaxing the posterior muscles of the lower legs will rotate, respectively, weights 80 between the first, lowered position (FIG. 2, solid lines) and the second, elevated position shown on FIG. 4. The force required to elevate weights 80 to the second, elevated position may also be selectively increased or decreased somewhat by person 90 moving, respectively, the person's feet closer to or farther away from the weights.

Figure 6:
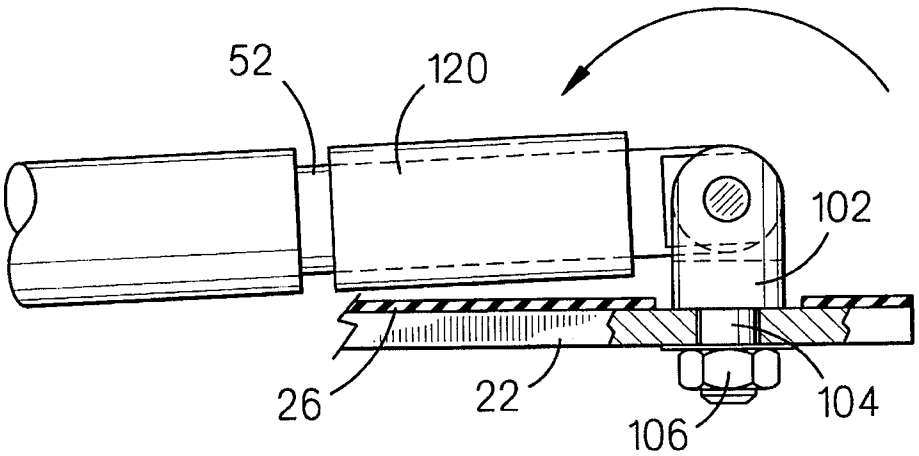
FIG. 6 is a fragmentary, side elevational view, partially in cross-section, showing the weight post of FIG. 5 in a folded position.
Figure 5:
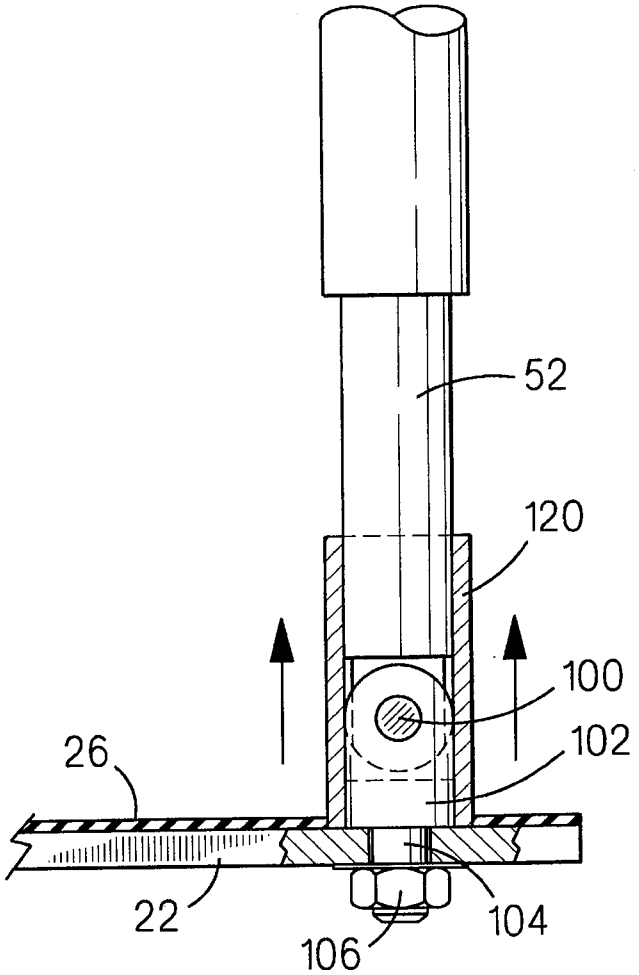
FIG. 5 is a fragmentary, side elevational view, partially in cross-section, showing the mounting of a weight post of the device in an upright position.

FIGS. 5 and 6 illustrate, with reference to weight post 52, the means by which weight posts 50 and 52 are mounted to the distal ends of plates 20 and 22. the proximal end of weight post 52 is rotatably fixedly attached to a horizontal shaft 100 which is journaled in a support fitting 102 fixedly attached to plate 22 by means of a threaded shaft 104 and a nut 106. A cylindrical collar 120 is movable between a first, lowered position (FIG. 5) in which the collar engages both the lower end of weight post 52 and support fitting 102, thus locking the weight post in a position orthogonal to plate 22, and a second, raised position (FIG. 6), permitting the weight post to be folded down on plate 22.

Figure 7:
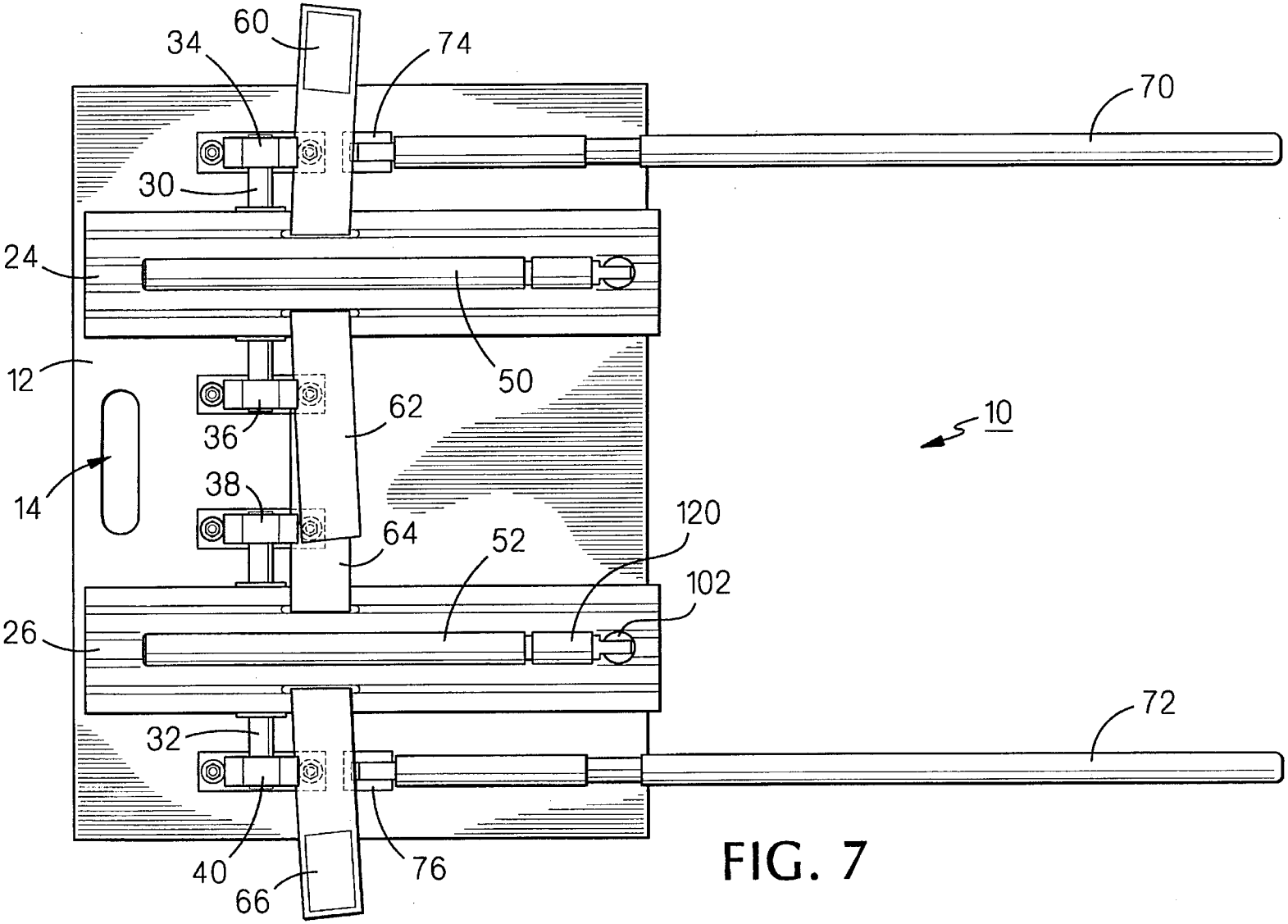
FIG. 7 is a top plan view showing the exercise device in a folded state for storage or transport.
Figure 8:
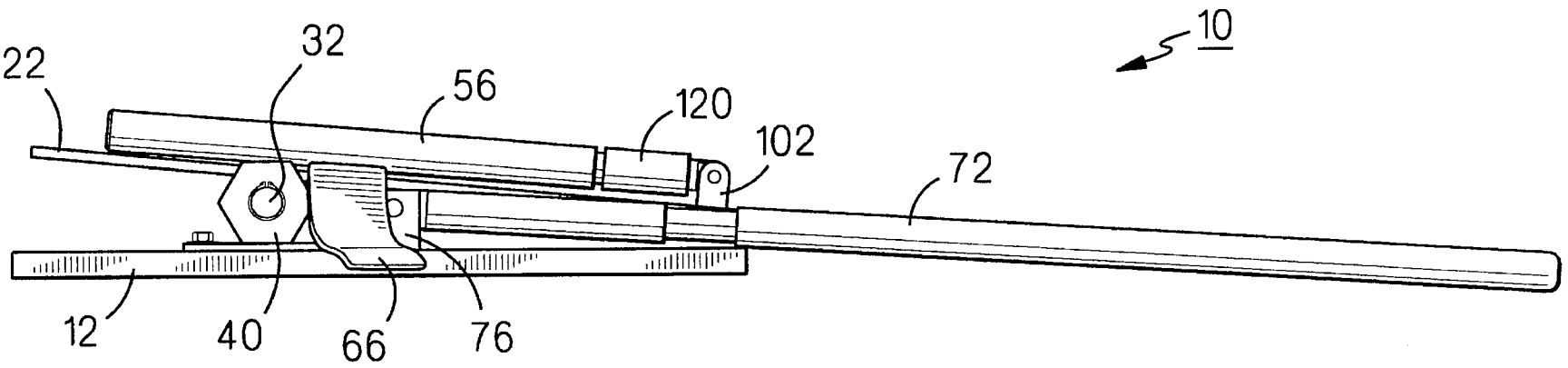
FIG. 8 is a side elevational view showing the exercise device in a folded state for storage or transport.

FIGS. 7 and 8 illustrate device 10 configured for storage or transport. Here, weights 80 (FIG. 2) have been removed and weight posts 50 and 52 folded, respectively, against plates 20 and 22. Support poles 70 and 72 have been telescoped to their shortest positions and folded against base member 12. So configured, device 10 is compact, relatively light, and easily stored or transported.

Device 10 can be economically constructed using conventional techniques and construction materials not noted above may be any suitable ones.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A lower leg exercise device, comprising:

(a) a base member;

(b) two, elongate, parallel plates attached to rotating means mounted on said base member;

(c) support means disposed at distal ends of said plates to accommodate thereon selected weights, said support means comprising posts extending upwardly from upper surfaces of said plates;

(d) a proximal end of each of said posts is rotatably fixedly attached to a horizontal shaft which is journaled in a support fitting attached to a said plate; and (e) a cylindrical collar is movable between a first, lowered position in which said collar engages both a lower end of said post and said support fitting, thus locking said post in a position orthogonal to said plate when said device is in use, and a second, raised position, permitting said post to be folded down on said plate for storage or transport when said device is not in use; such that a person standing on said plates, with a foot disposed over each of said rotating means, moves said weights between a first, lowered position and a second, elevated position by alternatingly flexing and relaxing muscles in the person's lower leg.

2. A lower leg exercise device, as defined in claim 1, further comprising: two support poles attached to said base member for the manual grasping of distal ends thereof by a user of said device.

3. A lower leg exercise device, as defined in claim 1, wherein said rotating means comprises: horizontal shafts journaled, respectively, in bearing block pairs fixedly attached to said base member.

4. A lower leg exercise device, as defined in claim 2, wherein said support poles are rotatably foldable against said base member for storage or transport when said device is not in use.

* * * * *